US006979169B2

(12) United States Patent
Penlesky et al.

(10) Patent No.: US 6,979,169 B2
(45) Date of Patent: Dec. 27, 2005

(54) MODULAR VENTILATING EXHAUST FAN ASSEMBLY AND METHOD

(75) Inventors: Robert G. Penlesky, Waukesha, WI (US); Daniel L. Karst, Beaver Dam, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 10/719,466

(22) Filed: Nov. 21, 2003

(65) Prior Publication Data

US 2005/0111972 A1 May 26, 2005

(51) Int. Cl.[7] ..... F04D 29/00

(52) U.S. Cl. ..... 415/1; 415/213.1; 415/214.1; 415/912; 416/175; 416/170 R; 416/203; 416/244 R; 417/423.7

(58) Field of Search ..... 415/213.1, 214.4, 415/912, 1, 214.1; 417/360, 423.1, 423.7; 416/175, 203, 170 R, 244 R

(56) References Cited

U.S. PATENT DOCUMENTS

| | | | |
|---|---|---|---|
| 1,532,635 | A | 4/1925 | Osbun |
| 2,189,008 | A | 2/1940 | Kurth |
| 2,278,581 | A | 4/1942 | Dexter |
| 2,483,377 | A | 9/1949 | Young |
| 2,562,600 | A | 7/1951 | Cadwell et al. |
| 2,668,491 | A | 2/1954 | Gerlitz |
| 2,673,514 | A | 3/1954 | Hanks |
| 2,710,573 | A | 6/1955 | Marker |
| 2,780,981 | A | 2/1957 | Miller |
| 2,875,678 | A | 3/1959 | Sheperd |
| 2,911,900 | A | 11/1959 | Rudy |
| 2,963,956 | A | 12/1960 | Hill |
| 2,987,258 | A | 6/1961 | North |
| 3,002,676 | A | 10/1961 | Papsdorf |
| 3,045,579 | A | 7/1962 | Jenn et al. |
| 3,064,548 | A | 11/1962 | Field |
| 3,068,341 | A | 12/1962 | Ortiz et al. |
| 3,075,335 | A | 1/1963 | Bandlow |
| 3,101,662 | A | 8/1963 | Alldritt |
| 3,211,080 | A | 10/1965 | Rader |
| 3,212,425 | A | 10/1965 | Hazen |
| 3,249,037 | A | 5/1966 | Stalker |
| 3,391,689 | A | 7/1968 | Roger |
| 3,577,710 | A | 5/1971 | Feldman |
| 3,606,593 | A | 9/1971 | Steiner |
| 3,636,306 | A | 1/1972 | Bumpus |

(Continued)

FOREIGN PATENT DOCUMENTS

| | | |
|---|---|---|
| BE | 648597 | 9/1964 |

(Continued)

OTHER PUBLICATIONS

Spartan Electric Company, Direct Drive Whole House Fans Publication, published prior to Nov. 2003.

(Continued)

*Primary Examiner*—Ninh H. Nguyen
(74) *Attorney, Agent, or Firm*—Michael Best & Friedrich LLP

(57) ABSTRACT

A ventilation exhaust fan is provided, and in some embodiments includes a housing adapted to interchangeably receive a first module having a first support plate and a second module having a second support plate. Each of the first and second modules have at least one of a motor and a fan wheel operable to generate a flow of fluid into and out of the exhaust fan. At least one of the motor and fan wheel of the first module is different from the motor and the fan wheel of the second module, respectively.

36 Claims, 7 Drawing Sheets

U.S. PATENT DOCUMENTS 3,692,977 A 9/1972 Duhamel et al.
3,698,833 A 10/1972 Cann et al.
3,732,030 A 5/1973 Mullings
3,743,439 A 7/1973 Cann
3,785,271 A 1/1974 Joy
3,788,207 A 1/1974 Doherty, II
3,861,894 A 1/1975 Marsh
3,926,537 A 12/1975 Piper
3,946,648 A * 3/1976 Schneider ..... 454/341
3,952,638 A 4/1976 Felter et al.
4,073,597 A 2/1978 Barnhart et al.
4,252,547 A 2/1981 Johnson
4,336,749 A 6/1982 Barnhart et al.
4,385,550 A 5/1983 Steiner et al.
4,385,911 A 5/1983 Popeil et al.
4,406,216 A 9/1983 Hott et al.
4,510,851 A 4/1985 Sarnosky et al.
4,594,940 A 6/1986 Wolbrink et al.
4,628,802 A 12/1986 Steiner
4,630,182 A 12/1986 Moroi et al.
4,867,640 A 9/1989 Penlesky et al.
5,664,872 A 9/1997 Spearman et al.
5,879,232 A 3/1999 Luter, II et al.
5,918,972 A 7/1999 Van Belle
5,934,783 A 8/1999 Yoshikawa
6,027,406 A 2/2000 Yazici
6,095,671 A 8/2000 Hutain
6,261,175 B1 7/2001 Larson et al.
6,340,237 B1 1/2002 Koga et al.
6,488,579 B2 12/2002 Larson et al.
6,498,423 B1 12/2002 Bell et al.
6,795,314 B1 * 9/2004 Arbogast et al. ..... 361/695

FOREIGN PATENT DOCUMENTS

CA 1332592 10/1994
FR 1234767 10/1960

OTHER PUBLICATIONS

Emerson Environmental Products, Whole House Fan and Shutter System Owners Manual, Dec. 1982.

* cited by examiner

FIG. 14
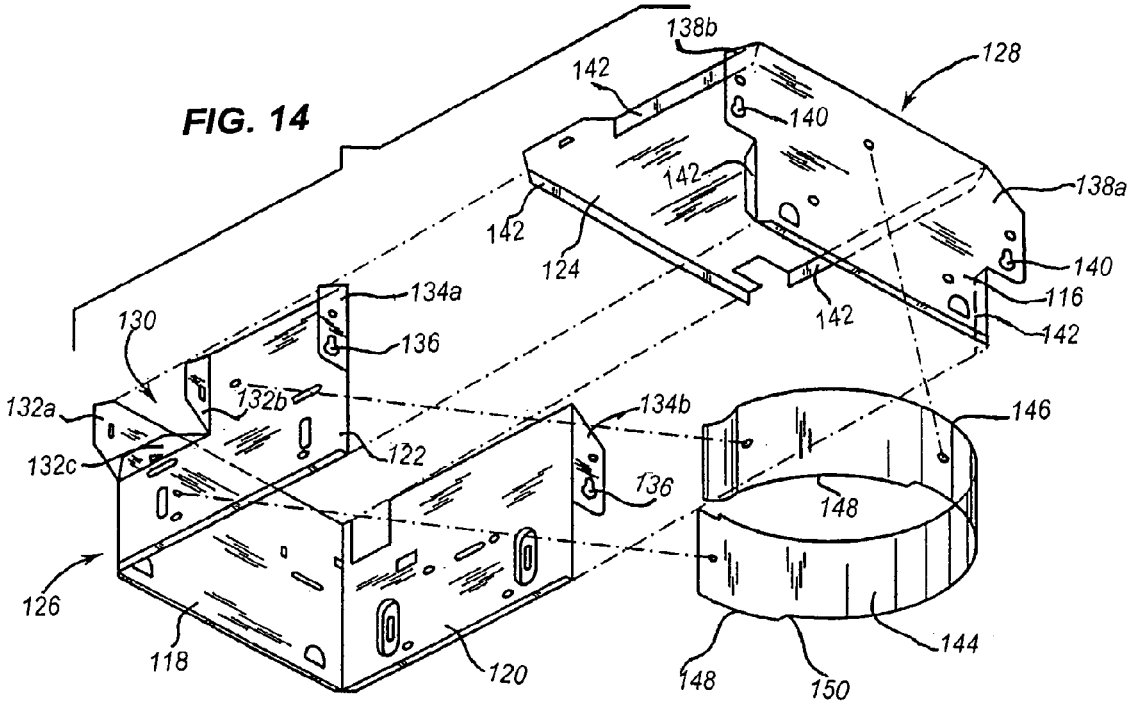
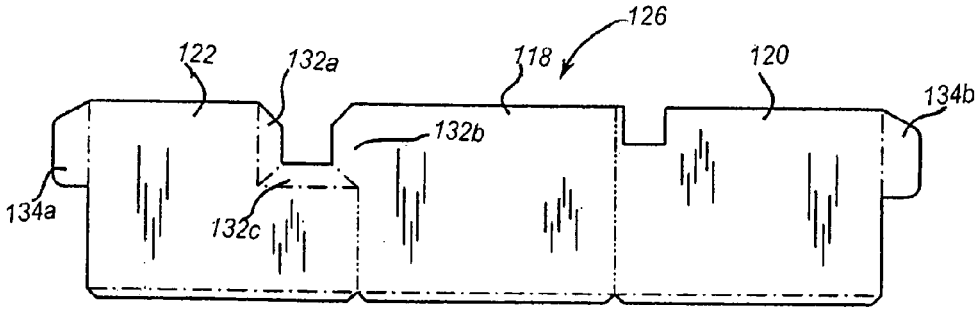
FIG. 14A
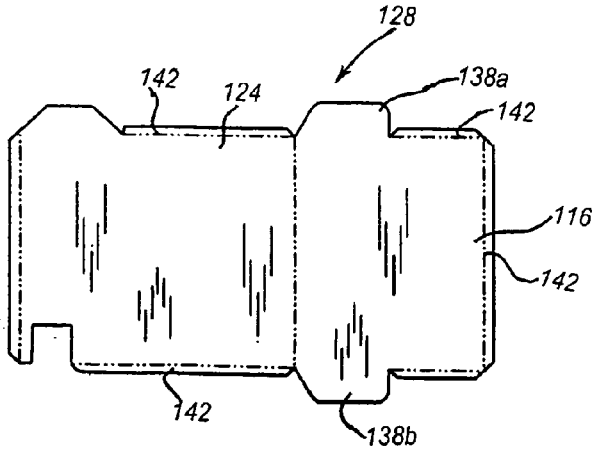
FIG. 14B

MODULAR VENTILATING EXHAUST FAN ASSEMBLY AND METHOD

BACKGROUND OF THE INVENTION

Ventilating exhaust fans, such as those typically included in bathrooms, draw air from within an area and pass the exhausted air out to another location, such as through a vent in the gable or roof of a home or other building structure. Ventilation is thus provided for the area. Centrifugal exhaust fans typically include a rotating fan wheel having a plurality of vanes that create an outward airflow which, in turn, is directed out of an outlet opening. The fan wheel is typically coupled to a driving motor supported within the fan housing. In some cases, a curved fan scroll is employed to channel air around the fan, and can be defined by a housing wall of the fan or by a separate element or structure within the fan housing.

Many typical exhaust fans currently in use include a housing positioned within a building structure, such as in an aperture in a wall or ceiling. The housing can be secured in the aperture in a number of conventional manners, such as by being attached to wall or ceiling joists, or by being attached to other structure in the wall or ceiling.

In some cases, it may be desirable to replace an exhaust fan for one or more reasons. For example, an old exhaust fan may need to be replaced when broken, or may generate unacceptable vibration or noise during operation. As another example, it may be desirable to replace an old exhaust fan with one that is more powerful and/or more efficient, or that has one or more features or characteristics different than the existing exhaust fan. However, conventional exhaust fans can be relatively difficult and time consuming to remove and replace, typically requiring the assistance of a qualified electrician, the disconnection and re-connection of associated ductwork, and the removal and re-installation of the entire exhaust fan from the building structure.

In light of the shortcomings and limitations of conventional ventilating exhaust fans, new ventilating exhaust fans would be welcome in the art.

SUMMARY OF THE INVENTION

Some embodiments of the present invention provide a ventilation exhaust fan comprising a housing having a fluid inlet through which fluid is received within the housing and a fluid outlet through which fluid exits the housing, wherein the housing is adapted to interchangeably receive a first module having a first support plate and a second module having a second support plate, each of the first and second modules having at least one of a motor and a fan wheel operable to generate a flow of fluid out of the fluid outlet, and wherein at least one of the motor and the fan wheel of the first module has a size different than the at least one of the motor and the fan wheel of the second module, respectively. In some embodiments, the size is an axial length of each fan, or alternatively, a dimension of each motor. In other embodiments, the size is a measure of the output of each motor.

In some embodiments of the present invention, a replacement ventilation exhaust module for replacement of an existing ventilation module in a fan housing is provided, wherein the existing ventilation module has a first support plate, a first motor coupled to the first support plate, and a first fan wheel drivably coupled to the first motor, wherein the first support plate is releasably coupled within the fan housing at a location, wherein the ventilation exhaust module comprises a replacement support plate adapted to be releasably coupled to the fan housing at the location, a replacement motor is coupled to the replacement support plate, and a replacement fan wheel is drivably coupled to the replacement motor, and wherein at least one of the replacement motor and replacement fan wheel is different in size than the first motor and first fan wheel, respectively. In some embodiments, the size is an axial length of each fan, or alternatively, a dimension of each motor. In other embodiments, the size is a measure of the output of each motor.

In another aspect of the present invention, a ventilation exhaust fan is provided, and comprises a fan housing having a plurality of walls defining an interior space and an outlet through which fluid is exhausted from the fan housing, a first mounting plate, a first motor coupled to the first mounting plate, a first fan drivably coupled to the first motor, wherein the first mounting plate, the first motor, and the first fan are removable from and insertable within the fan housing as a single unit, a second mounting plate, a second motor coupled to the second mounting plate, and a second fan drivably coupled to the second motor, wherein the second mounting plate, the second motor and the second fan are removable from and insertable within the fan housing as a single unit, and at least one of the first motor and first fan has a size different than the second motor and second fan, respectively. In some embodiments, the size is an axial length of each fan, or alternatively, a dimension of each motor. In other embodiments, the size is a measure of the output of each motor.

In yet another aspect of the present invention, a method of changing a ventilation exhaust fan is provided, and comprises providing a housing defining an interior space and having an opening communicating between the interior space and an exterior of the housing, providing a first module coupled to the housing, wherein the first module has a first support plate, a first fan wheel, and a first motor operably coupled to the first fan wheel, and wherein at least a portion of the first module extends into the interior space, uncoupling the first module from the housing, withdrawing the first module from the interior space, removing the first support plate from the opening, inserting at least a portion of a second module into the interior space, wherein the second module has a second support plate, and coupling the second module to the housing, wherein the second module has at least one of a second fan wheel and a second motor coupled to the second support plate, and wherein at least one of the second fan wheel and the second motor is different in size than the first fan wheel and the first motor, respectively.

Further aspects of the present invention, together with the organization and operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which illustrate certain embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numeral indicate like parts:

FIG. 14 is an exploded perspective view of the ventilating exhaust fan shown in FIGS. 3 and 4, illustrating a two-piece construction of the fan housing;

FIG. 14*a* is a front view of a first sheet of material used to form a first structural member defining the fan housing shown in FIGS. 3 and 4; and FIG. 14*b* is a front view of a second sheet of material used to form second structural member defining the fan housing shown in FIGS. 3 and 4.

DETAILED DESCRIPTION OF THE INVENTION

Figure 1:
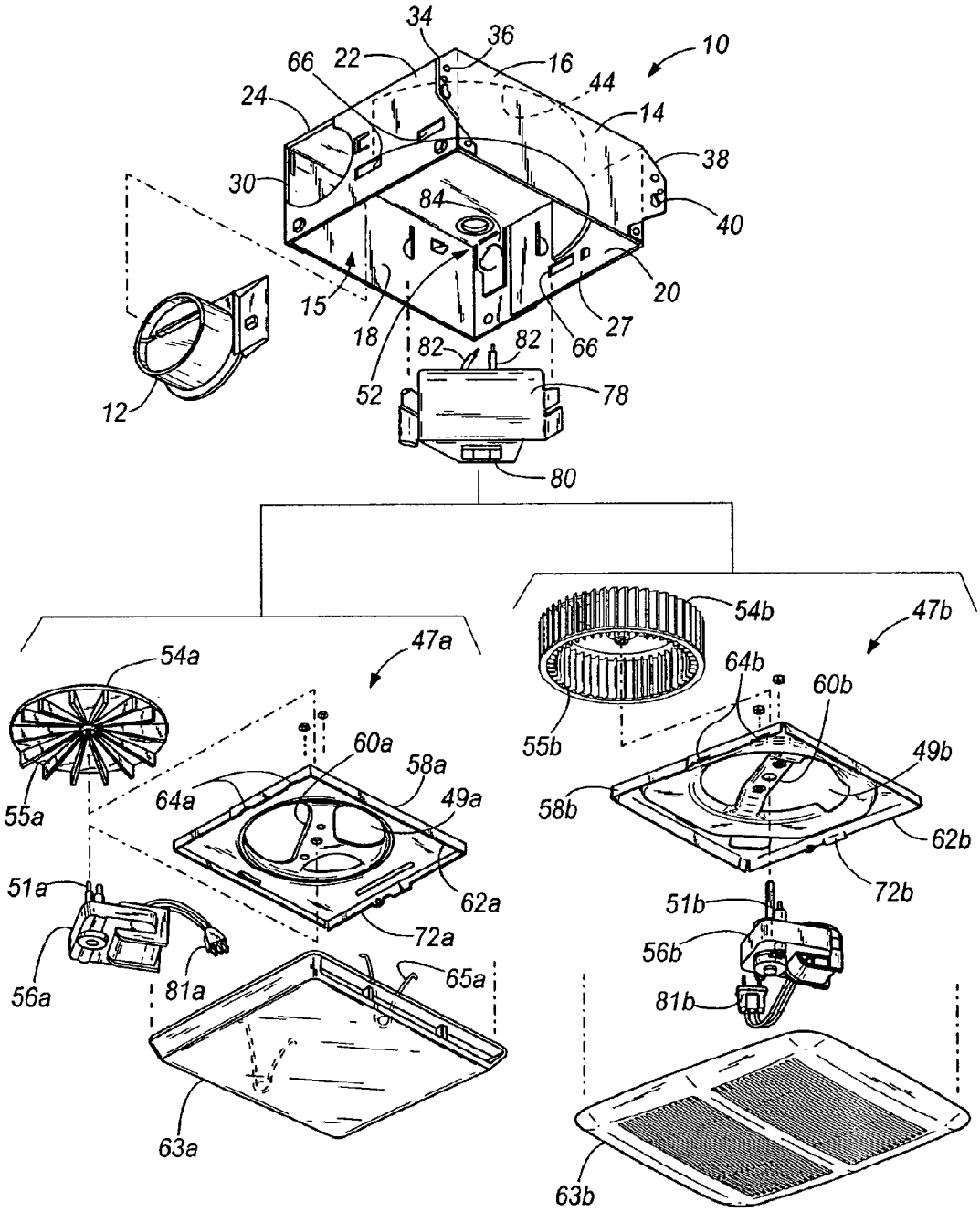
FIG. 1 is an exploded perspective view of a ventilating exhaust fan according to an exemplary embodiment of the present invention.

FIG. 1, illustrates a ventilating exhaust fan 10 according to an exemplary embodiment of the present invention. The ventilating exhaust fan 10 can be employed to ventilate any room or area, such as a bathroom or other structure. In use, the fan 10 can be mounted in any orientation, such as in a vertical orientation installed in a wall, a horizontal orientation installed in a ceiling, or in any other orientation desired.

In some embodiments, the fan 10 is secured within a wall, ceiling, or other building structure in a partially or fully recessed position. In such cases, the fan 10 can be received within an aperture in the wall, ceiling, or other building structure, and can be secured to any suitable element(s) (e.g., one or more wall or ceiling joists) in order to secure the fan 10 in place within the aperture. A cover or louver 63*a* of the fan 10 can extend beyond the exterior plane of the ceiling or wall. The fan 10 can operate to draw air through one or more apertures or vents in the louver 63*a* and to discharge the air through an outlet. In some embodiments, the fan 10 has an outlet fitting 12 through which airflow exits the fan 10. The outlet and/or outlet fitting 12 of the fan 10 can have any shape (round, oval, rectangular, irregular, and the like) for connection to a similarly sized duct that directs the airflow to another location.

Although the embodiments of the present invention refer to the movement, intake, and exhaust of air and airflow, it will be appreciated that the fan 10 of the present invention can be employed to move, intake, and discharge any gas or combination of gasses desired. Accordingly, terms referring to "air" herein and in the appended claims are understood to encompass such other fluids.

The fan 10 can have a housing 14 formed from sheet metal or other suitable material of a thickness sufficient to provide the necessary structural strength for the exhaust fan 10 and components thereof (e.g., the motor 56*a* and the fan wheel 54*a*). The housing 14 can have any shape desired, such as a round shape, a rectangular, triangular, or other polygonal shape, an irregular shape, and the like. By way of example only, the housing 14 illustrated in FIGS. 1, 2*a*, and 2*b* has a generally rectangular shape, and has a back wall 16, a front wall 18, sidewalls 20, 22, and a base wall 24. Together, the back wall 16, front wall 18, sidewalls 20, 22, and base wall 24 at least partially define an interior space 15 of the fan 10. The back wall 16, front wall 18, and sidewalls 20, 22 can define an opening 27 of the housing 14 between the interior space 15 and an exterior of the housing 14.

In some embodiments of the present invention, fasteners (not shown) are employed to secure the housing 14 (and therefore, the exhaust fan 10) to a building structure. In such cases, the fasteners can attach any part of the housing 14 to the building structure, such as the back wall 16, front wall 18, either sidewall 20, 22, the base wall 24, or flanges located anywhere on the housing 14, and can extend through attachment holes 36, 40 for this purpose. In the illustrated embodiment of FIGS. 1–2*b*, fasteners can pass through attachment holes 36, 40 in mounting flanges 34, 38 adjacent the back wall 16 of the housing 14, thereby securing the back wall 16 of the housing 14 to a joist, sub-joist, wall stud, or any other structural support. In other embodiments, fasteners can pass through one or more of the back wall 16, the front wall 18, either side wall 20, 22 and/or the base wall 24 to secure the housing 14 to the building structure. Any conventional fastener can be employed to secure the housing 14 as just described, such as screws, nails, rivets, pins, posts, clips, clamps, inter-engaging elements, and any combination of such fasteners.

Figure 2A:
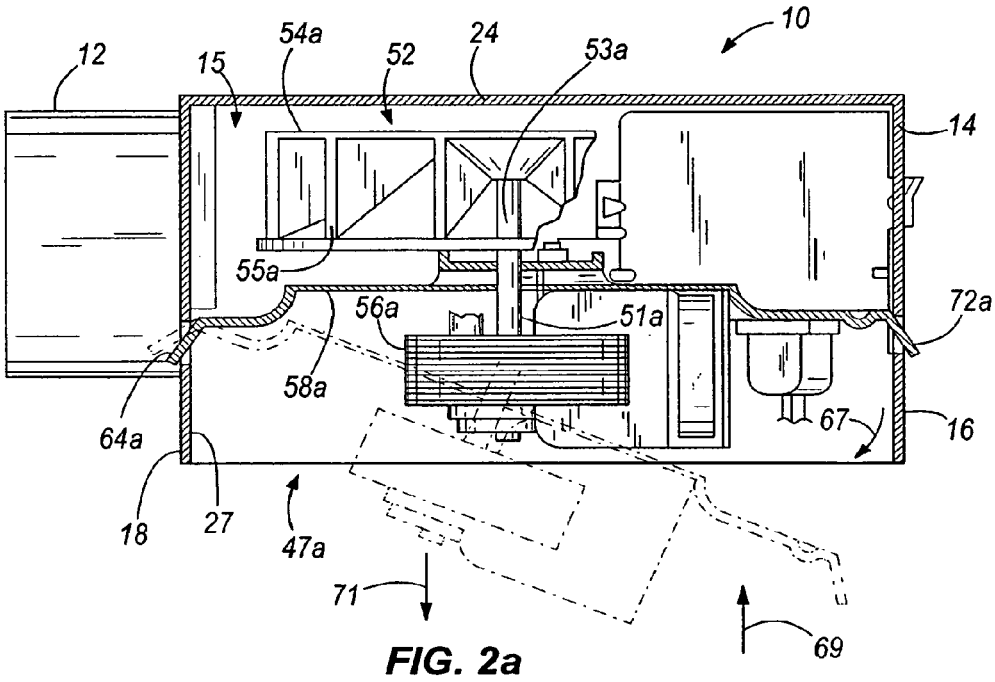
FIG. 2*a* is a sectional view of the ventilating exhaust fan shown in FIG. 1 and illustrating the mounting of a first module within the fan housing.
Figure 2B:
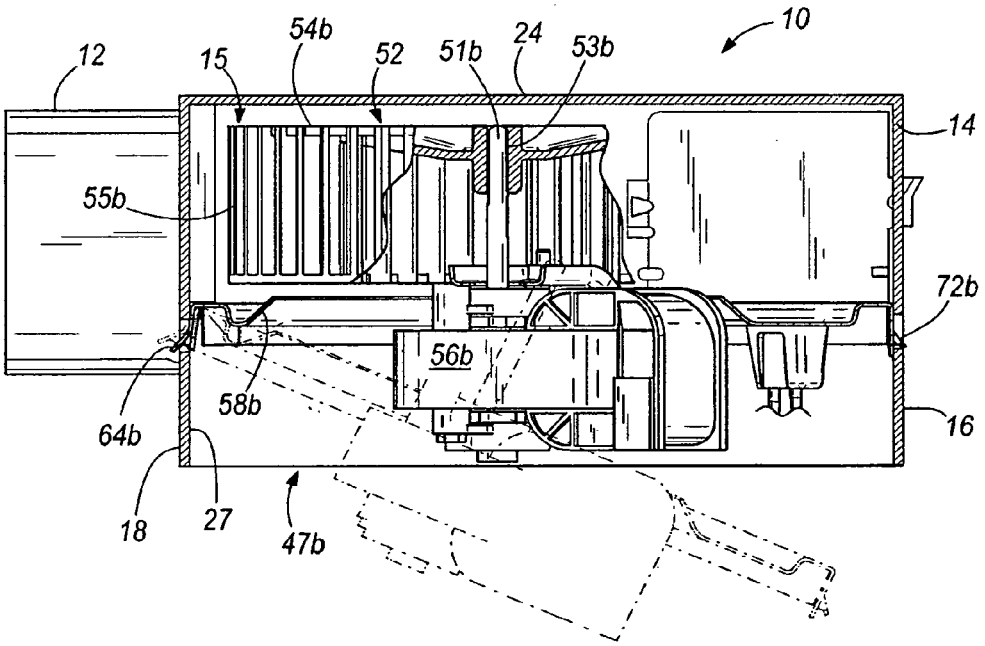
FIG. 2*b* is a sectional view of the ventilating exhaust fan shown in FIG. 1 and illustrating the mounting of a second module within the fan housing different than the first module.

The exhaust fan 10 in the embodiment of FIGS. 1–2*b* is oriented substantially horizontally (i.e., with the base wall 24 being substantially perpendicular to a structural support). However, in alternate embodiments the exhaust fan 10 can also or instead be oriented vertically with respect to any building structure (i.e., with the base wall 24 being substantially parallel to a structural support). In still other embodiments, the exhaust fan 10 can have other orientations with respect to the building structure and its structural support(s), determined at least in part by space constraints, the orientation of structural supports, the spacing between structural supports, and whether the exhaust fan 10 is mounted in a wall or a ceiling.

Field wiring can extend through the building structure and can transmit electrical power to the location of the fan 10. As used herein and in the appended claims, the term "field wiring" includes electrical connections, electrical wiring, electrical circuits, and any other electrical elements and systems used to transmit or otherwise carry electrical power in the building structure.

In some embodiments, the fan 10 includes an electrical connector 80 for releasable connection to a motor 56*a*. In other embodiments, the fan 10 can be provided with two or more electrical connectors 80 for supplying electrical power to two or more electrical components, such as a lighting assembly or a nightlight. The electrical connector(s) 80 can be located in a panel 78 as shown in FIG. 1 or in any other wall, framework, or structure of the fan 10. One or more wires 82 can be electrically connected to and extend from the electrical connector 80, and can be connected to field wiring supplying power to the fan 10. Such connections can be located within an enclosure defined at least in part by the panel 78, if employed. By way of example only, in the illustrated embodiment of FIGS. 1–2*b*, an electrical connector 80 is retained in a panel 78 removably secured to walls 20, 18 of the housing 14. An electrical enclosure is defined between the panel 78, a portion of each of the walls 20, 18, and a portion of the base wall 24. The panel 78 can have flanges that are slidably received within slots in the side and front walls 20, 18 to retain the panel 78 in place as best shown in FIG. 1.

The housing 14 can be provided with one or more suitable openings through which field wiring can extend. Such openings can be defined in one or more wiring plates, or can be defined in one or more walls of the housing as shown in FIG. 1. If desired, a plate 84 can be used to cover one or more holes not used to route wires in the electrical connection of the fan 10. As explained below in greater detail, the electrical connector 80 can be employed to supply electrical power to one or more electrical components of the exhaust fan 10, including, for example, a fan motor, a lighting assembly, and the like. Additionally, in some embodiments, the electrical connector 80 is selectively engageable with a number of different electrical connectors, thereby facilitating electrical connection between the field wiring 43 and a number of different electrical components selectively installed in the housing 14.

With continued reference to the illustrated exemplary embodiment of FIGS. 1–2*b*, a sidewall 22 of the housing 14 defines an outlet opening 30 to which an outlet fitting 12 is attached in any conventional manner (although the outlet opening 30 can be in any location on the housing 14 depending at least partially upon the location and orientation of the fan wheel 54*a* and the motor 56*a*. If employed, the outlet fitting 12 can be connected to an exhaust duct or other components of an exhaust duct system extending away from the fan 10 to exhaust air to another location. During operation, the exhaust fan 10 operates to draw air from a room or other area through the opening 27 and to discharge the airflow out through the outlet fitting 12 and the exhaust duct system. In some embodiments, the exhaust duct system includes a flexible fluid conduit. In other embodiments, the exhaust duct system can include other conduits, such as pipes, tubing, hoses, cavities in solid bodies, combinations of such elements and structures, and the like. Therefore, as used herein and in the appended claims, the term "exhaust duct" or "exhaust duct system" refers to any conduit, passage, or chamber (or combinations thereof) through which fluid can be transported, and unless otherwise stated is independent of the length, diameter and other shape, material, flexibility or inflexibility, or other properties of such elements and structures.

As shown in FIG. 1, in some embodiments, the housing 14 supports a centrifugal fan scroll 44. The fan scroll 44 can be coupled to any wall or combination of walls of the housing 14, such as to the sidewall 22, back wall 16, and front wall 18 as shown in FIG. 1. In the illustrated exemplary embodiment, the fan scroll 44 is spot welded to the sidewall 22, back wall 16, and the front wall 18. In other embodiments (not shown), the fan scroll 44 can be connected to the housing via screws, bolts, nails, rivets, pins, posts, clips, clamps, and/or other conventional fasteners, inter-engaging elements on the fan scroll 44 and the housing 14 (e.g., tabs, flanges, or other extensions on the fan scroll 44 inserted within slots, grooves, or other apertures in the housing wall(s), and vice versa), by adhesive or cohesive bonding material, or in any other suitable manner. The fan scroll 44 can define a fan wheel chamber 52 in the housing 14. In still other embodiments (not shown), the exhaust fan 10 can be constructed without a fan scroll 44.

As shown in FIGS. 1 and 2*a*–2*b*, in some embodiments the fan housing 14 is adapted to selectively and interchangeably receive first and second modules 47*a*, 47*b* defining part or all of the moving components of the exhaust fan 10. In other words, and as explained in greater detail below, the exhaust fan 10 can be configured in either of two configurations using the first and second modules 47*a*, 47*b*. As discussed in greater detail below, the modules 47*a*, 47*b* are different from each other in at least one manner, such as size, shape, efficiency, power, and the like. Features and elements of the first module 47*a* are identified herein with a reference number and the letter "a", while corresponding features and elements in the second module 47*b* include the same reference number and the letter "b". By using selectively interchangeable modules 47*a*, 47*b* as just described, the exhaust fan 10 can be assembled and installed in a structure with the first module 47*a*, and can then be reconfigured as needed or desired by removing the first module 47*a* and replacing the first module 47*a* with the second module 47*b*. Similarly, the exhaust fan 10 can be assembled and installed in a structure with the second module 47*b* and can then be reconfigured as needed or desired by removing the second module 47*b* and replacing the second module 47*b* with the first module 47*a*.

It will be appreciated that while reference is made herein and in the appended claims to an exhaust fan 10 having two modules 47*a*, 47*b* and to an exhaust fan 10 having two configurations corresponding to the two modules 47*a*, 47*b*, alternate embodiments of the present invention (not shown) can include three, four, or more modules and can be assembled in any number of different configurations corresponding to the modules.

As shown in FIGS. 1 and 2*a*, the first module 47*a* includes a support plate 58*a*. The support plate 58*a* can be a substantially planar member defining an intake aperture 49*a*. When the support plate 58*a* is coupled to the housing 14 as will be described in greater detail below, the intake aperture 58*a* communicates between opposite sides of the support plate 58*a* to provide fluid flow through the support plate 58*a*. The support plate 58*a* can be defined by a single element (such as a stamped piece of material) or set of elements (such as a plate to which a bracket and/or one or more other elements are attached), and can take other forms, including without limitation a frame, series of supports or trusses, and the like.

In the illustrated exemplary embodiment, the support plate 58*a* includes an outer peripheral edge 62*a* that is shaped to correspond to at least part of the shape of the housing 14, although such a shape correspondence is not required to practice the present invention. The outer peripheral edge 62*a* of the support plate 58*a* can have any shape desired, and in the illustrated embodiment is substantially rectangular. Also, the outer peripheral edge 62*a* of the support plate 58*a* in the illustrated exemplary embodiment is at least partially defined by a lip or side walls oriented at an angle with respect to the rest of the support plate 58*a*, thereby providing one or more locations of the support plate 58*a* by which the support plate 58*a* can be connected to the housing 14. Any type of fastener or fastening feature can be employed at these locations, such as tabs or flanges 64*a*, 72*a*, apertures through which screws, bolts, nails, rivets, pins, posts, or other conventional fasteners can be passed, fingers or other protrusions that can extend into apertures or other features in the walls of the housing 14, and the like.

For example, in some embodiments (such as that illustrated in the figures), a plurality of fasteners 64*a*, 72*a* are formed on the support plate 58*a* in desired locations and orientations for securing the support plate 58*a* to the housing 14. Any number of fasteners 64*a*, 72*a* can be located anywhere along the support plate 58*a* as desired, and in some embodiments are located along the outer peripheral edge 62*a* of the support plate 58*a*. In the illustrated exemplary embodiment of FIGS. 1–2*b*, the fasteners 64*a*, 72*a* are configured as outwardly extending protrusions or tabs and are located on opposite sides of the support plate 58*a*. In these and other embodiments, the fasteners 64*a*, 72*a* can be configured to engage corresponding apertures 66 in the housing 14. The fasteners 64*a*, 72*a* can also be used to secure the entire first module 47*a* to the housing 14. The shape, size, and location of the fasteners 64*a*, 72*a* can be selected to correspond to the shape, size, and location of the apertures 66 in the housing 14.

In some embodiments, the same support plate 58*a* can have two or more fasteners 64*a*, 72*a* or sets of fasteners 64*a*, 72*a* (of the same or different type, and in any location or combination of locations desired) so that the support plate 58*a* can be fitted to two or more different fan housings 14 having different connection elements or features. Alternatively or in addition, the support plate 58*a* can have two or more fasteners 64*a*, 72*a* or sets of fasteners 64*a*, 72*a* (of the same or different type, and in any location or combination of locations desired) so that the support plate 58*a* can be mounted to the same housing 14 in two or more different orientations. As such, it is not necessary for all of the fasteners 64*a*, 72*a* of the support plate 58*a* to be utilized when securing the support plate 58*a* to the housing 14 or when mounting the first module 47*a* to the housing 14. In a similar manner, the housing 14 can include two or more apertures 66 or sets of apertures 66 such that two or more different support plates 58*a* can be coupled to the housing 14 or such that the same support plate 58*a* can be coupled to the housing 14 in two or more different orientations.

The support plate 58*a*, and the shape and configuration of the outer peripheral edge 62*a*, the fastener 64*a*, 72*a*, and the apertures 66 described above are presented by way of example only. It will be appreciated that the shape and configuration of the outer peripheral edge 62*a*, the fastener 64*a*, 72*a*, and the apertures 66 can vary greatly. Accordingly, in alternate embodiments, the shape and size of the outer peripheral edge 62*a*, and the number, type, and location of the fasteners 64*a*, 72*a* and apertures 66 can be changed. By way of example only, in other embodiments (not shown), the housing 14 can include fasteners 64*a*, 72*a* and the support plate 58*a* can include corresponding apertures 66 to mount the support plate 58*a* in the housing 14. As described above, other conventional fasteners (e.g., screws, bolts, nails, rivets, pins, posts, and the like) or other fastening features and elements can also or instead be used to secure the support plate 58*a* to the housing 14 and/or to secure the first module 47*a* in the housing 14.

In some embodiments, the first module 47*a* includes a motor 56*a*, and can also include a motor mounting bracket 60*a* that is integral with the support plate 58*a* or is attached to the support plate 58*a* via conventional fasteners or in any other suitable manner. The motor mounting bracket 60*a* can be positioned in any manner enabling the motor 56*a* to be secured to the support plate 58, and in some embodiments extends across the intake aperture 49*a*. The motor mounting bracket 60*a* can be configured to support the motor 56*a* within the housing 14 so that a drive shaft 51*a* of the motor 56*a* is oriented along an axis extending to a fan wheel 54*a* in the housing 14. In some embodiments, the motor 56*a* can be oriented so that the axis of the drive shaft 51*a* extends generally perpendicularly through the intake aperture 49*a*, although the drive shaft 51*a* can extend through or past the support plate 58*a* in other manners as desired. In the illustrated embodiment, the mounting bracket 60*a* is integrally formed with the support plate 58*a*.

The motor 56*a* can have a number of different sizes, shapes, and power outputs. In the illustrated embodiment for example, the motor 56*a* has a substantially cubic configuration.

Although the fan wheel 54*a* can be driven by any type of device (such as by an electric motor, a hydraulic motor, and the like), an electric motor 56*a* is employed in the illustrated exemplary embodiment. In those embodiments employing an electric motor 56*a*, the motor 56*a* can include an electrical connector 81*a* (such as a plug) electrically engageable with the electrical connector 80 of the housing 14 (described above) for supplying electrical power to the motor 56*a*. The plug or other electrical connector 81*a* of the motor 56*a* can be male, female, or can be any other type desired. Similarly, the electrical connector 80 of the housing 14 can be male, female, or can be any other type adapted for connection to the electrical connector 81*a* of the motor 56*a*.

In some embodiments, the electrical connectors 81*a*, 80 are releasably connectable. Although plug and socket connectors 81*a*, 80 are illustrated in the exemplary embodiment of FIGS. 1–2*b*, any other releasable electrical connectors can be employed to releasably electrically connect the motor 56*a* to the power supply of the fan 10.

The first module 47*a* can also include a fan wheel 54*a*. In the illustrated embodiment, the fan wheel 54*a* has a paddle-wheel configuration. However, in alternate embodiments of the present invention, the fan wheel 54*a* can have a squirrel cage configuration, or can have any other rotating fan configuration desired. The fan wheel 54*a* is attached to and supported by the motor drive shaft 51*a* for rotational motion in the fan wheel chamber 52, and can includes a plurality of individual blades or vanes 55*a* that create a centrifugal flow of air when the fan wheel 54*a* rotates.

In some embodiments and as shown in FIG. 1, the fan wheel 54*a* includes a central mounting hub 53*a* having one or more independent fingers that frictionally engage the drive shaft 51*a* of the motor 56*a*. In other embodiments, the fan wheel 54 can be secured to the drive shaft 51*a* of the motor 54*a* in any other manner, such as by one or more setscrews, clamps, or other conventional fasteners, by a splined, keyed, pinned, compression, or interference fit connection, and the like.

In the illustrated exemplary embodiment of FIGS. 1–2*b*, the module 47*a* has a fan wheel 54*a* drivably connected to a motor 56*a* on opposite sides of the support plate 58*a*, wherein the fan wheel 54*a* is located between the base wall 24 and the support plate 58*a*. However, the positions of the fan wheel 54*a* and motor 56*a* can be reversed in other embodiments (in which case the locations of the fan scroll 44 and the outlet opening 30 can be changed to be appropriately positioned with respect to the fan wheel 54*a*). In still other embodiments, the fan wheel 54*a* and motor 56*a* can be located on the same side of the support plate 58*a*.

In some embodiments, the first module 47*a* is at least partially covered by the cover 63*a*, and can extend outwardly past a surface of a wall, ceiling, or other building structure in which the exhaust fan 10 is installed. The cover 63*a* can be part of the first module 47*a*, or can be an element separate from the first module 47*a*. The cover 63*a* can provide an aesthetically pleasing appearance of the exhaust fan 10 while allowing air flow into the exhaust fan 10. The cover 63*a* can be secured to the rest of the exhaust fan 10 in any manner, such as by screws, bolts, nails, rivets, pins, posts, and the like, by inter-engaging elements on the cover 63*a* and on the fan housing 14 and/or support plate 58*a*, and the like. For example, the cover 63*a* in the illustrated exemplary embodiment is connected to the support plate 58*a* by spring wires, which engage corresponding recesses in the support plate 58*a* to secure the cover 63*a* to the housing 14 and/or the support plate 58*a*.

The elements of the second module 47*b* are substantially similar in many ways to the elements of the first module 47*a* described above. Accordingly, with the exception of mutually inconsistent features and elements between the first and second modules 47*a*, 47*b*, reference is hereby made to the description above regarding the first module 47*a* for a more complete description of the features, elements, (and alternatives to such features and elements) of the second module 47*b*.

With reference to FIGS. 1 and 2*b*, in some embodiments, the second module 47*b* includes a support plate 58*b*, a motor 56*b* mountable on the support plate 58*b*, and a fan wheel 54*b* mountable on a drive shaft 51*b* of the fan motor 56*b*. A cover 63*b* can also be employed to cover at least part of the second module 47*b*. The cover 63*b* can be part of the second module 47*b*, or can be an element separate from the second module 47*b*.

The support plate 58*b* can take any shape and size, and in some cases is a substantially planer member. In some embodiments, the support plate 58*b* has an intake aperture 49*b* through which air moves in the housing 14. A motor mounting bracket 60*b* can be employed to mount the motor 56*b* to the support plate 58*b*, and in some embodiments extends across the intake aperture 49*b*. In the illustrated embodiment, the mounting bracket 60*b* is shaped to receive at least part of the motor 56*b*, such as by defining a recess in the mounting bracket 60*b*. For example, in some embodiments a central portion of the mounting bracket 60*b* can be curved with respect to the ends of the mounting bracket 60*b*, thereby enabling the motor 56*b* to be recessed with respect to the mounting bracket 60*b*.

In the illustrated embodiment, the mounting bracket 60*b* is coupled to the support plate 58*b* in a conventional manner (e.g., with conventional fasteners, by welding, by inter-engaging elements on the mounting bracket 60*b* and the support plate 58*b*, and the like). However, in alternative embodiments, the mounting bracket 60*b* is integrally formed with the support plate 58*b*.

Like the motor 56*a* of the first module 47*a* described above, the motor 56*b* of the second module 47*b* can have any shape, size, and power output. In the illustrated embodiment for example, the motor 56*b* has a substantially cubic configuration.

With continued reference to FIG. 2*b*, the fan wheel 54*b* in the illustrated exemplary embodiment is positioned on a side of the support plate 58*b* facing the base wall 24. More particularly, in the illustrated embodiment, an edge of a venturi portion of the support plate 58*b* faces and extends toward the fan 54*b*. As used herein and in the appended claims, the term "venturi" includes any conduit or passage having a tapered section for concentrating fluid flow and increasing fluid velocity as the fluid flows through the conduit or passage. In other embodiments, a portion of the fan wheel 54*b* is received in a recess defined within the support plate 58*b*. Although any type, shape, and size of fan wheel 58*b* can be employed, the fan wheel 58*b* in the illustrated exemplary embodiment is a squirrel cage fan wheel 58*b*.

The fan wheel 54*b* described above and illustrated in FIG. 2*b* is adjacent to and spaced a distance from a recess of the support plate 58*b*. However, in other embodiments the fan wheel 54*b* or portions of the can wheel can be recessed within a recess defined by the support plate 58*b*. Also, in some embodiments the support plate 58*b* can be shaped to have a recess facing the motor 56*b*, which can therefore be recessed within the support plate 58*b* as desired (in which case the mounting bracket 60*b* can have a shape permitting this relationship between the motor 56*b* and the support plate 58*b* as necessary).

The second module 47*b* can have one or more components that are different in one or more manners than the first module 47*a*. For example, the second module 47*b* can have a larger or smaller motor 56*b* than the motor 56*a* of the first module 47*a*, can have a motor 56*b* with a different shape and/or different power output than the motor 56*b* of the first module 47*a*, and can have a different type of motor 47*b* than the motor 56*a* of the first module 47*a*. Alternatively or in addition, the second module 47*b* can have a larger or smaller fan wheel 54*b* (e.g., larger or smaller in diameter, larger or smaller in thickness, or larger or smaller in any other manner) than the fan wheel 54*a* of the first module 47*a*, and can have a fan wheel 54*b* with a different shape and/or type than the fan wheel 54*a* of the first module 47*a*. In some cases, such as where it is desirable to employ at least some of the same support plate mounting elements or features of the housing 14 to mount both modules 47*a*, 47*b*, the ability to recess the motor 56*a*, 56*b* and/or the fan wheel 54*a*, 54*b* in the support plate 58*b* can enable the use of differently sized motors 56*a*, 56*b* and/or fan wheels 54*a*, 54*b* in the same housing 14.

For example, the fan wheel 54*b* of the second module 47*b* is larger in thickness than the fan wheel 54*a* of the first module 47*a*. The thicker fan wheel 54*b* of the second module 47*b* can be accommodated in some embodiments by recessing the fan wheel 54*b* into the support plate 58*b* as described above. In some embodiments, the support plate 58*b* is recessed and the fan wheel 54*b* is not receive in the recessed portion of the support plate 58. In these embodiments, the recessed portion of the support wheel 54*b* provides additional clearance for movement of the fan wheel 54*b* and can facilitate increased fan wheel performance.

Similarly, the longer motor 56*b* of the second module 47*b* can be accommodated in some embodiments (such as the illustrated embodiment of FIGS. 1–2*b*) by employing a deeper cover 63*b*. By way of example only, the cover 63*b* in the illustrated exemplary embodiment of FIGS. 1–2*b* is different than the cover 63*a*, and has a deeper interior enabling a longer motor 56*b* to be received within the housing 14 and cover 63*b*.

Accordingly, some embodiments of the present invention provide an exhaust fan 10 having a module that can be changed as desired, such as to install a module with a more powerful motor, a larger fan, or having any other desirable feature(s).

In some embodiments of the present invention, the first module 47*a* is pre-assembled and is inserted into the housing 14 as a single integral element or unit prior to installation of the exhaust fan 10 in the structure. Alternatively, in some embodiments, the housing 14 can be installed in the building structure and the first module 47*a* can be inserted into the housing 14 after the housing 14 has been installed in the building structure.

After the first module 47*a* is inserted into the interior space 15 and is coupled to the housing 14, it may be necessary to replace the first module 47*a* (or one or more elements of the first module 47*a*). By way of example only, a user may desire a quieter fan wheel or a more powerful motor. Accordingly, the first module 47*a* can be removed from the housing 14 and can be replaced with the second module 47*b*. In addition, and as described in greater detail below, in some embodiments of the present invention, the first module 47*a* can be removed from the housing 14 and can be replaced with the second module 47*b* and/or elements of the second module 47*b* without removing the housing 14 from the building structure, without uncoupling the outlet fitting 12 from the exhaust duct system, and/or without disconnecting the electrical connector 80 from the field wiring 43.

To remove the first module 47*a* from the housing 14, the cover 63*a* and the fasteners 65*a* (if employed) are uncoupled from the support plate 58*a* and housing 14. The cover 63*a* can then be moved away from the housing 14, and in some embodiments can be disconnected and set aside for later use with the second module 47*b* (or alternatively, can be discarded).

After the cover 63*a* of the exhaust fan 10 has been removed, the electrical connector 81*a* of the motor 56*a* can be disconnected from the electrical connector 80 of the housing 14. In some embodiments, this disconnection requires no tools, and is simply performed by manually unplugging or disconnecting the electrical connectors 81*a*, 80.

With the cover 63*a* removed, the support plate 58*a* is accessible through the opening 27 in the housing 14. In some embodiments, an installer can apply an upward and outward force to the support plate 58*a* to uncouple the fasteners 72*a* from the housing 14. In these and other embodiments, one or more fasteners 72*a* can be released or removed in any other manner, depending upon the type of fastener(s) 72*a* employed.

In some embodiments, after the fasteners 72*a* have been uncoupled from the housing 14, the support plate 58*a* and the rest of the first module 47*a* can be drawn from the housing 14. With continued reference to the exemplary illustrated embodiment of FIGS. 1–2*b*, in some embodiments the support plate 58*a* can pivot (e.g., about one or more of the fasteners 64*a* or about another location) away from an installed position in order to remove the first module 47*a* from the housing 14, although any other support plate motion is possible in various embodiments. In the illustrated exemplary embodiment, the support plate 58*a* is pivoted in a downward direction represented by arrow 67 in FIG. 2*a* from a first position (shown in solid lines in FIG. 2*a*) in which the support plate 58*a* is substantially parallel to the base wall 24, toward a second position (shown in phantom in FIG. 2*a*), in which the support plate 58*a* oriented at an angle with respect to the support plate 58*a*.

In some embodiments, one or more of the fasteners 64*a* remain coupled to the housing 14 after the support plate 58*a* has been at least partially pivoted toward the second position so that the support plate 58*a* can hang from the housing 14 without requiring support from the installer.

The electrical connectors 81*a*, 80 described above and illustrated in the figures are accessible to an installer with the support plate 58*a* in place. However, in some embodiments, these electrical connectors 81*a*, 80 are shielded by the support plate 58*a* or are otherwise accessible only after the support plate 58*a* has been moved or removed. In such cases, after the support plate 58*a* has been moved or removed, the installer can insert a hand into the interior space 15 of the housing 14 to uncouple the connector 81*a* of the motor 56*a* from the connector 80 of the housing 14.

To detach the support plate 58 from the housing 14 in some embodiments, the installer moves the support plate 58 in an upward direction (represented by arrow 69 in FIG. 2*a*) from the second position toward a third position (not shown), in which the fasteners 64*a* are moved from the apertures 66 in the housing 14. The installer can thereby uncouple the fasteners 64*a* from the housing 14 and can move the support plate 58*a* and the other elements of the first module 47*a* in a downward direction (represented by arrow 71) through the opening 27 and out of the interior space 15.

After the first module 47*a* has been removed from the housing 14, an installer can insert the second module 47*b* into the housing 14. In some embodiments of the present invention, the second module 47*b* is assembled prior to shipment to the installer. In other embodiments, the installer assembles the second module 47*b* and/or elements of the second module 47*b* prior to installation of the second module 47*b* in the housing 14 as described above. Accordingly, assembly of the second module 47*b* can be performed by the installer, or alternatively, by the manufacturer.

After the second module 47*b* has been assembled and/or after elements of the second module 47*b* have been assembled, the installer can insert the second module 47*b* into the housing 14 as a single integral element or unit. With reference to the illustrated exemplary embodiment, for example, the installer can move the second module 47*b* toward a first position with respect to the housing 14 (not shown), in which the support plate 58*b* is at an angle with respect to the base wall 24, such as at an acute or perpendicular angle with respect to the base wall 24. In this position, the installer can connect one or more of the fasteners 64*b* to the housing 14 so that the support plate 58*b* can hang freely from the housing 14. In those embodiments in which the connectors 81*b*, 80 are accessible for connection only before the support plate 58*b* is fully installed, the installer can then insert a hand into the housing 14 to connect the connector 81*b* of the motor 56*b* to the connector 80 of the housing 14. In some embodiments, this connection can be made manually without the use of tools.

After the motor 56*b* and any other electrically powered elements of the second module 47*b* (e.g., an electric lighting assembly) are electrically connected to the connector 80, the installer can pivot the second module 47*b* upwardly into the interior space 15 of the housing 14 and toward a second position, such as a position in which the support plate 58*b* is substantially parallel to the base wall 24. In the second position, the installer couples any remaining fasteners 72*a* to the housing 14.

The support plate 58*b* can instead be inserted within the housing 14 in any other manner (e.g., using a sliding or translating motion or a combination of sliding an translating motions, and the like), and need not necessarily first connect one or more fasteners 64*b* prior to pivoting the support plate 58*b* as described above.

In those embodiments (such as the illustrated embodiment of FIGS. 1 and 2*a*) employing electrical connectors 81*b*, 80 that are accessible after the support plate 58*b* has been installed in the housing 14, the installer can connect the electrical connectors 81*b*, 80 to establish power to the motor 56*b* of the second module 47*b*. In some embodiments, this connection can be made manually without the use of tools.

In the illustrated embodiment of FIGS. 1–2*b*, fasteners 65*b* couple the cover 63*b* to the support plate 58*b* after the support plate 58*b* has been inserted into the interior space 15 and after the support plate 58*b* has been coupled to the housing 14. However, in alternative embodiments of the present invention, the cover 63*b* can be coupled to the support plate 58*b* before the support plate 58*b* is inserted into the interior space 15 and before the support plate 58*b* is coupled to the housing 14.

While reference is made herein to embodiments of the present invention in which the first module 47*a* is initially installed in the housing 14 and is later replaced by the second module 47*b*, it should be understood that in alternative embodiments of the present invention, the second module 47*b* is initially installed in the housing 14 and is then replaced by the first module 47*a*.

In the illustrated exemplary embodiment of FIGS. 1–2*b*, the first module 47*a* includes the support plate 58*a*, the motor 56*a*, the fan wheel 54*a*, and the cover 63*a*, while the second module 58*b* includes the support plate 58*b*, the motor 56*b*, the fan wheel 54*b*, and the cover 63*b*. Accordingly, in the illustrated exemplary embodiment of FIGS. 1–2*b*, replacing the first module 47*a* with the second module 47*b* includes removing the support plate 58*a*, the motor 56*a*, the fan wheel 54*a*, and the cover 63*a* from the housing 14 and inserting the support plate 58*b*, the motor 56*b*, the fan wheel 54*b*, and the cover 63*b* into the housing 14.

However, in alternative embodiments of the present invention, either or both of the first and second modules 47*a*, 47*b* do not include the fan wheel 54*a*, 54*b* (respectively). In such cases, the first module 47*a* still includes the support plate 58*a* and the motor 56*a* (with or without the cover 63*a*), and/or the second module 47*b* still includes the support plate 58*b* and the motor 56*b* (with or without the cover 63*b*). For example, in those cases where neither module 47*a*, 47*b* includes a fan wheel 54*a*, 54*b*, replacing the first module 47*a* with the second module 47*b* includes removing the motor 56*a* and the support plate 58*a* from the housing 14 and inserting the support plate 58*b* and the motor 56*b* into the housing 14. In these and other embodiments, the housing 14 can include a mounting bracket (not shown) for rotatably securing the fan wheel 54*a* within the housing 14 during removal and replacement of the support plate 58*a* and the motor 56*a*, and enabling the motor 56*a*, 56*b* to be connected to and disconnected from the fan wheel 54*a* in any suitable manner.

In some embodiments of the present invention, either or both of the first and second modules 47*a*, 47*b* do not include the motor 56*a*, 56*b* (respectively). In such cases, the first module 47*a* still includes the support plate 58*a* and the fan wheel 54*a* (with or without the cover 63*a*), and/or the second module 47*b* still includes the support plate 58*b* and the fan wheel 54*b* (with or without the cover 63*b*). For example, in those cases where neither module 47*a*, 47*b* includes a motor 56*a*, 56*b*, replacing the first module 47*a* with the second module 47*b* includes removing the fan wheel 54*a* and the support plate 58*a* from the housing 14 and inserting the support plate 58*b* and the fan wheel 54*b* into the housing 14. In these and other embodiments, the housing 14 can include a mounting bracket (not shown) for securing the motor 56*a* within the housing 14 during removal and replacement of the support plate 58*a* and the fan wheel 54*a*, and enabling the fan wheel 54*a*, 54*b* to be connected to and disconnected from the motor 56*a* in any suitable manner.

In addition, while reference is made herein to embodiments of the present invention in which the second module 47*b* is installed in the housing 14 after the housing 14 has been installed in a structure, in alternative embodiments of the present invention, the housing 14 can be removed from the structure prior to installation of the second module 47*b*.

FIGS. 3–14*b* illustrate another embodiment of the present invention similar in many ways to the illustrated embodiment of FIGS. 1, 2*a*, and 2*b* described above. Accordingly, with the exception of mutually inconsistent features and elements between the embodiment of FIGS. 3–14*b* and the embodiment of FIGS. 1, 2*a*, and 2*b*, reference is hereby made to the description above accompanying the embodiment of FIGS. 1, 2*a*, and 2*b* for a more complete description of the features and elements (and the alternatives to the features and elements) of the embodiment of FIGS. 3–14*b*. Features and elements in the embodiment of FIGS. 3–14*b* corresponding to features and elements in the embodiment of FIGS. 1, 2*a*, and 2*b* are numbered in the 100 and 200 series.

The fan housing 114 in the illustrated exemplary embodiment of FIGS. 3–14*b* includes a back wall 116, a front wall 118, and a pair of sidewalls 120 and 122. The back wall 116, front wall 118 and sidewalls 120 and 122 are joined to form a generally rectangular enclosure having an open bottom end and a top end closed by a base wall 124, as best shown in FIG. 14.

As illustrated in FIGS. 14, 14*a* and 14*b*, the fan housing 114 is a two-piece construction formed from a first structural member 126 and a second structural member 128. The first structural member 126 is a flat sheet of material, such as galvanized steel, that is bent into the configuration shown in FIG. 14 to define the front wall 118 and the pair of sidewalls 120 and 122. In addition, the first structural member 126 defines an outlet opening 130 having three extending outlet flanges 132*a*–132*c*.

The first structural member 126 includes a first pair of mounting flanges 134*a* and 134*b* that each extend perpendicular to one of the sidewalls 120 and 122. As can be understood in FIGS. 14 and 14*a*, each of the mounting flanges 134*a* and 134*b* are bent at an angle of 90° relative to the respective sidewall 120, 122 to which it is attached. Each mounting flange 134*a*, 134*b* includes an attachment hole 136 through which a support member, such as a screw, passes to support the fan housing 114 on the ceiling joist.

Referring now to FIGS. 14 and 14*b*, the second structural member 128 is a flat sheet of material, such as galvanized steel, that is bent to define both the back wall 116 and the base wall 124. The second structural member 128 includes a second pair of mounting flanges 138*a* and 138*b* that each extend directly from the back wall 116 and each include an attachment hole 140. When the first structural member 126 and the second structural member 128 are joined to each other, the first pair of mounting flanges 134*a* and 134*b* are aligned with the second pair of mounting flanges 138*a* and 138*b* such that the material thickness is doubled in the area of the fan housing 114 that supports the fan housing on the ceiling joist. The second structural member 128 includes peripheral edge tabs 142 that are bent over and used to join the first structural member 126 to the second structural member 128 in a conventional manner.

In the embodiment of the invention illustrated, both the first structural member 126 and the second structural member 128 are stamped from sheets of galvanized steel, which produces only small amounts of scrap. In both the first and second structural members, the mounting flanges are formed from the continuous sheet of material, such that the mounting flanges do not need to be attached to the fan housing 114 after the fan housing has been assembled. In prior fan housings for similar exhaust fans, the mounting flanges are either attached to the fan housing in a separate step or each of the sidewalls 120 and 122, as well as the back wall 116, are formed from separate sheets of material to create the double thickness of material in the mounting flanges. By utilizing the two-piece construction of the present invention, significant material and labor costs can be saved during construction of the fan housing 114.

As can be understood in FIG. 14, the fan housing 114 is formed from two individual pieces of material that are each bent to desired configuration and joined to each other. Most importantly, the two-piece configuration for the fan housing 114 provides for a double material thickness in the area of the fan housing that supports the weight of both the fan housing 114 and the internal operating components.

Figure 4:
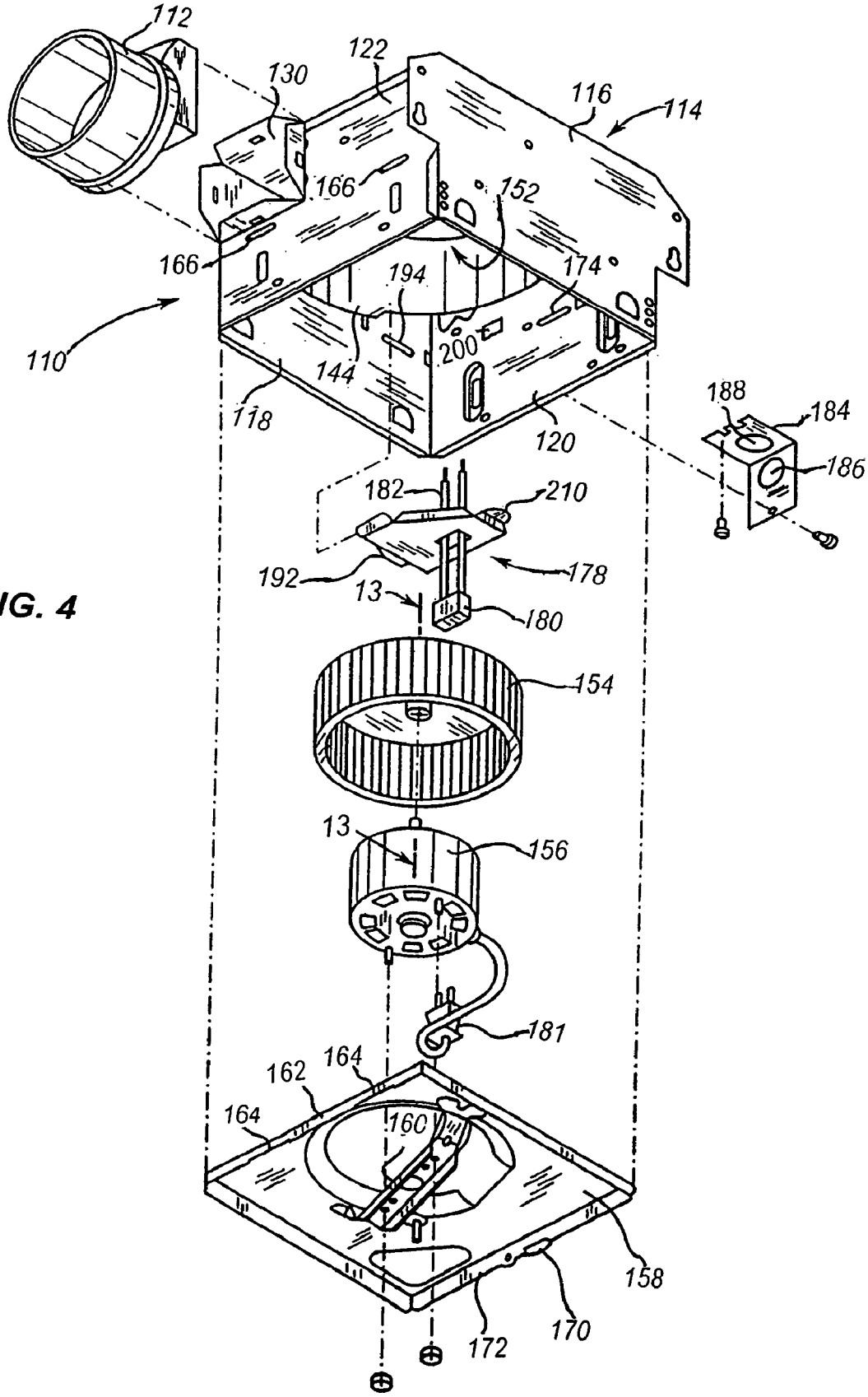
FIG. 4 is an exploded perspective view of the ventilating exhaust fan illustrated in FIG. 3.

Referring now to FIG. 4, the fan housing 114 generally defines an open interior that includes a curved sheet of metallic material that defines a centrifugal fan scroll 144. As can be seen in FIG. 14, top edge surface 146 of the fan scroll 144 contacts the inner surface of the base wall 124. Fan scroll 144 is secured to the sidewall 122, back wall 116 and the front wall 118. The fan scroll 144 includes a bottom edge surface 148 that includes a reduced height pre-load notch 150, the significance of which will be discussed in greater detail below. The fan scroll 144 defines a fan wheel chamber 152 that is sized to receive a fan wheel 154, as best illustrated in FIG. 4. The fan wheel 154 includes a plurality of individual vanes that create a centrifugal flow of air when the fan wheel 154 rotates. The fan wheel 154 is mounted to a driving motor 156 that is operable to rotate the fan wheel to create a flow of air out of the outlet opening 130 and through the outlet fitting 112. The motor 156 is supported within the fan wheel chamber 152 by a motor support plate 158 and an attached motor mounting bracket 160.

Figure 5:
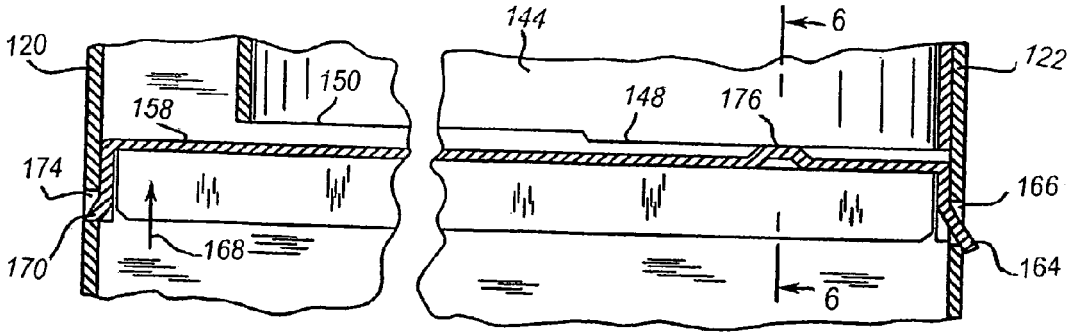
FIG. 5 is a partial section view of the ventilating exhaust fan shown in FIGS. 3 and 4, taken along line 5—5 of FIG. 3 and illustrating the interaction between the motor support plate and the fan scroll of the exhaust fan.
Figure 6:
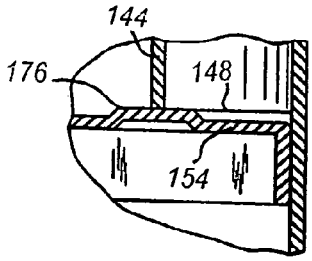
FIG. 6 is partial section view of the ventilating exhaust fan shown in FIGS. 3 and 4, taken along line 6—6 of FIG. 5 and further illustrating the interaction between a detent formed on the motor support plate and the fan scroll.

Referring now to FIGS. 4 and 5, the motor support plate 158 includes a first peripheral edge flange 162 having a pair of tabs 164 that extend completely through corresponding slots 166 formed in the sidewall 122 of the fan housing 114. The interaction between the pair of tabs 164 formed on the motor support plate 158 and the slots 166 formed in the sidewall 122 aid in holding the motor support plate 158 within the fan housing 114 against the force of gravity.

Once the pair of tabs 164 have been inserted into the slots 166 in the sidewall 122, the opposite edge of the motor support plate 158 can be pushed upward, as illustrated by arrow 168, until an angled tab 170 formed on a second peripheral edge flange 172 engages a slot 174 formed in the sidewall 120. When the angled tab 170 is received within the slot 174, the motor support plate 158 is securely held within the open interior of the fan housing 114 between the rectangular sidewalls 120 and 122.

When the motor support plate 158 is installed within the fan housing 114, as best illustrated in FIG. 5, a detent 176 stamped into the motor support plate 158 contacts the bottom edge surface 148 of the fan scroll 144. The detent 176 spaces the remaining portions of the motor support plate 158 slightly above the bottom edge surface 148 of the fan scroll 144. The pre-load notch 150 formed on the fan scroll 144 creates a larger physical separation between the motor support plate 158 and the fan scroll 144 in that area, which allows the motor support plate 158 to move slightly upward, as illustrated by arrow 168, such that the angled tab 170 can be removed from slot 174 to permit the motor support plate 158 to be removed from within fan housing 114. Without the decreased height of the fan scroll 144 along the area identified by the pre-load notch 150, removal of the motor support plate 158 would be much more difficult due to the nearly identical dimensions of the fan housing 114 and the motor support plate 158.

Referring back to FIG. 4, the exhaust fan 110 includes a receptacle panel 178 that supports at least one electrical receptacle 180 within the fan housing 114. In the embodiment of the invention illustrated, the single electrical receptacle 180 receives the plug 181 of the motor 156. An additional electrical receptacle 180 could also be supported by the receptacle panel 178 to provide power for an optional lighting assembly (not shown). Electrical receptacle 180 includes a pair of wires 182 that are connected to the supply of electricity for the home in which the exhaust fan 110 is installed to provide power for the fan. In accordance with the present invention, the receptacle panel 178 is removably mounted within the fan housing 114 and can be removed and installed without the aid of any tools. The wires 182 are field-connected to power source wires that pass through a wire plate 184 connected to both the base wall 124 and the sidewall 120. The wire plate 184 includes a horizontal access hole 186 and a vertical access hole 188 to permit the power source wires to pass through either the base wall 124 or the sidewall 120. The vertical access hole 188 is shown in the preferred embodiment of the invention as including a knockout that can be removed if vertical wiring access is required. The wire plate 184 can be removed from the fan housing 114 to provide unlimited wiring access from the outside of the fan housing 114. The wire plate 184 can be reverse-mounted to the fan housing 114 to permit the power source wires to pass through either the base wall 124 or the sidewall 120 without removing the knockout.

Figure 11:
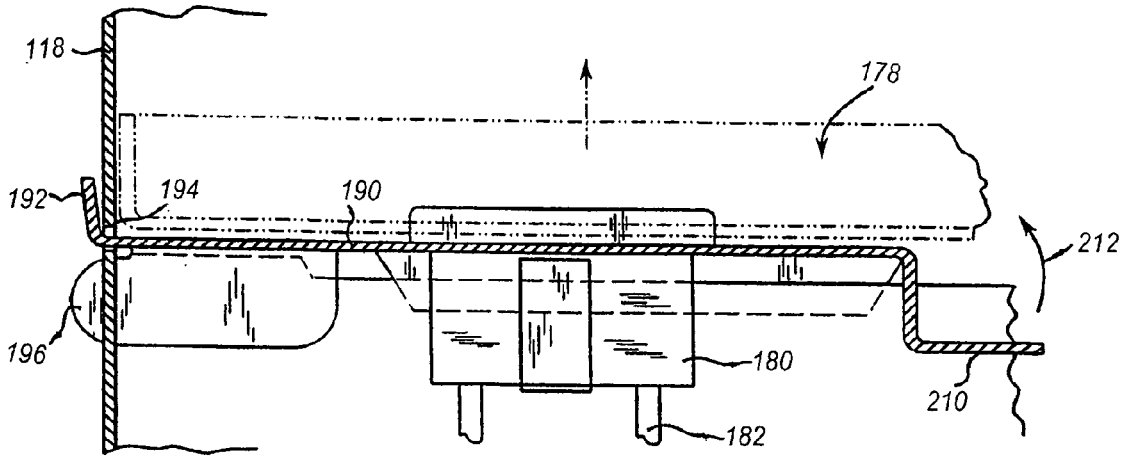
FIG. 11 is a section view of the ventilating exhaust fan shown in FIGS. 3 and 4, taken along line 11—11 of FIG. 9 and further illustrating the mounting of the receptacle panel within the fan housing.

Referring now to FIG. 11, the receptacle panel 178 generally includes a horizontal base plate 190 and a first locking tab 192 that extends vertically from the base plate 190. Locking tab 192 extends through a mounting slot 194 formed in the front wall 118 to aid in holding the receptacle panel 178 in contact with the front wall 118. Additionally, a pair of ears 196 extend vertically from the base plate 190 and pass through corresponding slots in the front wall 118 to aid in holding the receptacle panel 178 in place.

After the locking tab 192 and ears 196 are positioned in the corresponding slots in the front wall 118, a locking flange 198 extending vertically from the base plate 190 is pressed behind a retaining clip 200 formed as part of the sidewall 120. The retaining clip 200 includes a curved portion 202 that is received within an open notch 204 formed in the locking flange 198 such that the retaining clip 200 retains the receptacle panel 178 in the position shown.

Figure 10:
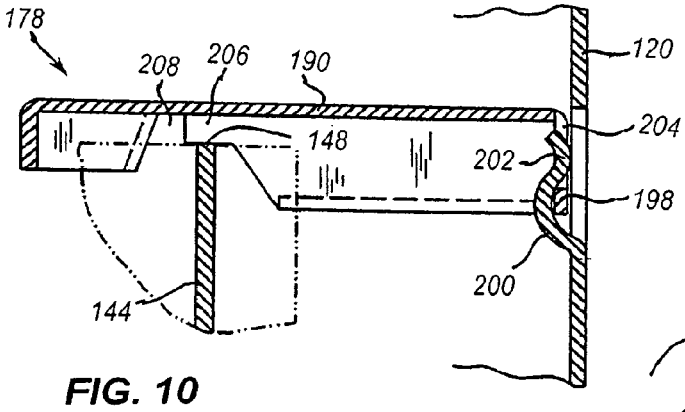
FIG. 10 is a section view of the ventilating exhaust fan shown in FIGS. 3 and 4, taken along line 10—10 of FIG. 9 and illustrating the mounting of the receptacle panel within the fan housing.

When the receptacle panel 178 is pressed into its installed position as shown in FIG. 10, a spacer tab 206 protruding from the base plate 190 contacts the bottom edge surface 148 of the fan scroll 144 to create an opening 208 between the base plate 190 and the fan scroll 144. The opening 208 provides adequate spacing between the base plate 190 and the fan scroll 144 to allow a wire 182 of the receptacle 180 to pass between the top edge 148 of the fan scroll 144 and the base plate 190. The spacing between the base plate 190 and the fan scroll 144 prevents inadvertent severing of the wire 182 during installation of the receptacle panel 178.

Figure 9:
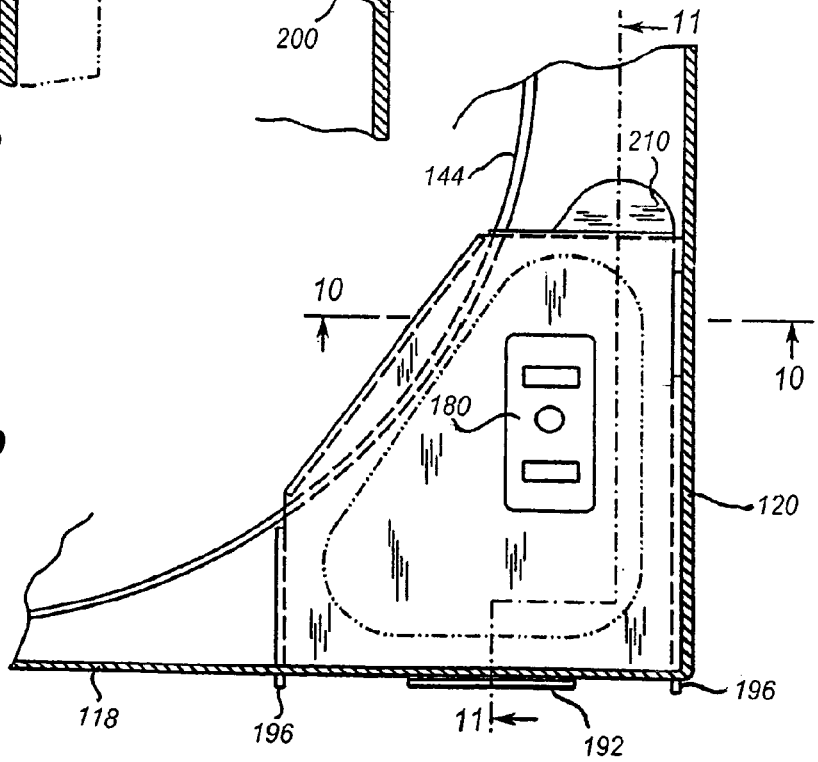
FIG. 9 is a partial top plan view of the ventilating exhaust fan shown in FIGS. 3 and 4, illustrating a receptacle panel installed within the fan housing.

Referring now to FIGS. 9 and 11, the receptacle panel 178 further includes a horizontal removal tab 210 that can be grasped by the user to pull the receptacle panel 178 from its installed position. Specifically, the removal tab 210 is positioned between the fan scroll 144 and the sidewall 120 and can be grasped by the user to pull the receptacle panel 178 out of the fan housing 114, as illustrated by arrow 212, against the frictional interaction formed between the retaining clip 200 and the locking flange 198.

The removable receptacle panel 178 of the present invention allows a builder or electrician installing the exhaust fan 110 to connect the wires 182 to the supply of electricity for the house outside of the fan housing 114. Once the wires 182 have been connected to the supply of electricity for the home, the wires 182 can be pulled through the fan housing 114 and the receptacle panel 178 installed within the fan housing 114 as previously described.

Figure 3:
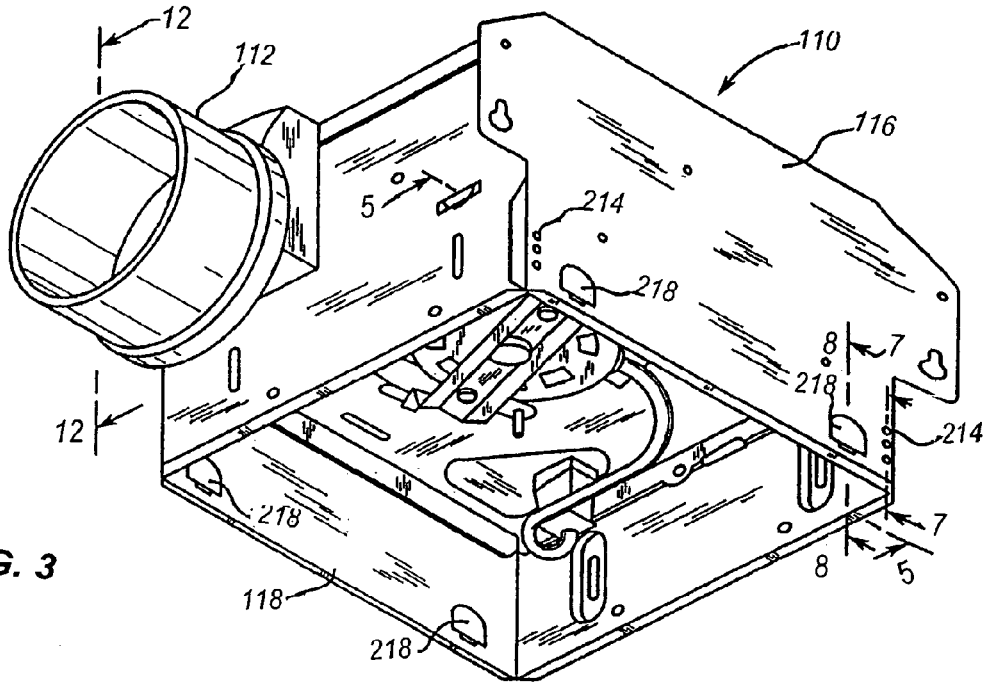
FIG. 3 is a perspective view of a ventilating exhaust fan according to another exemplary embodiment of the present invention.
Figure 7:
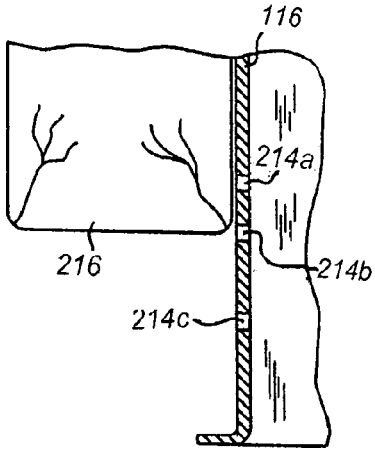
FIG. 7 is a section view of the ventilating exhaust fan shown in FIGS. 3 and 4, taken along line 7—7 of FIG. 3 and illustrating view holes formed in a back wall of the fan housing used to aid in alignment of the fan housing along a structural member.

Referring now to FIGS. 3 and 7, the back wall 116 of the fan housing 114 includes two series of vertically spaced view holes 214. The view holes 214 allow the installer of the exhaust fan 110 to look through the back wall 116 and the open interior defined by the fan housing 114 and view the position of the ceiling joist 216 relative to the fan housing 114. The view holes 214 are spaced from each other by set distances to accommodate common thickness' of drywall. For example, the uppermost hole 214*a* shown in FIG. 7 can be aligned with the bottom of the joist 216 when drywall having a thickness of 1¼ inches is utilized. The middle hole 214*b* corresponds to one inch thick drywall, while the bottom hole 214*c* is spaced for use with ⅝ inch thick drywall. In the preferred embodiment of the invention, an indicia corresponding to the drywall thickness for the individual view hole 214 is stamped into the back wall 116 immediately next to the view hole 214.

In the past, the installer of an exhaust fan had to measure the distance from the bottom edge of the fan housing 114 to the bottom of the joist in order to determine the proper placement of the fan housing. By utilizing the two spaced series of view holes 214, the installer or electrician can not only correctly space the bottom edge of the fan housing from the bottom of the ceiling joist, but also ensure that the fan housing 114 is level by properly aligning the two series of view holes 214.

Figure 8:
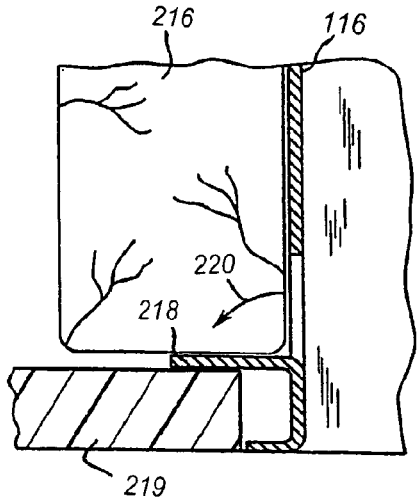
FIG. 8 is a section view of the ventilating exhaust fan shown in FIGS. 3 and 4, taken along line 8—8 of FIG. 3 and illustrating a bend down tab used to aid in alignment of the fan housing along a structural member.

Referring now to FIGS. 3 and 8, the back wall 116 further includes a pair of bend down tabs 218 that can be moved from the generally vertical, storage position shown in FIG. 3 to a horizontal, operating position shown in FIG. 8. When the bend down tabs 218 are in the horizontal, operating position, the tabs 218 can be pressed against the bottom edge of the ceiling joist 216 to provide the required spacing for ½ inch thick drywall 219, which is the most common drywall used in newly constructed homes. Thus, if the installer or builder knows that ½ inch thick drywall is going to be used in the bathroom in which the exhaust fan 110 is installed, the installer can press the bend down tabs 218 into their horizontal position, as indicated by arrow 220, and place the bend down tabs 218 in contact with the bottom edge surface of the ceiling joist 216, thus quickly and accurately positioning the fan housing 114 on the ceiling joists 216. In addition to being contained on the back wall 216, a pair of similar bend down tabs 218 can also be formed in the front wall 118 of the fan housing 114, as illustrated in FIG. 3. In this manner, the two pair of bend down tabs 218 can be used to level and support the fan housing 114 between adjacent ceiling joists 216.

Figure 12:
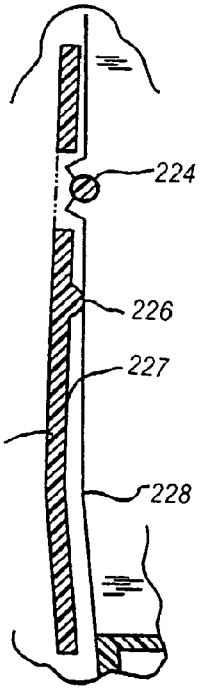
FIG. 12 is a section view of the ventilating exhaust fan shown in FIGS. 3 and 4, taken along line 12—12 of FIG. 3 and illustrating the construction of an exhaust flap positioned adjacent to an exhaust outlet of the fan housing.

Referring now to FIG. 12, the outlet fitting 112 includes a plastic damper flap 222 that pivots about a pivot pin 224 to open or block access to the outlet opening 130 formed in the fan housing 114. When the motor 156 and fan wheel 154 are rotating, airflow from the exhaust fan 110 forces the damper flap 222 to rotate outward in a clockwise direction to permit airflow to be vented to the outside of the home. However, when the motor 156 and fan wheel 154 are inactive, a back draft causes the damper flap 222 to rotate in the counter-clockwise direction to prevent the back draft from entering into the bathroom or enclosed area in which the exhaust fan 110 is mounted.

In the preferred embodiment of the invention illustrated, a pair of stop pins 226 extend from the back face surface 227 of the damper flap 222 and contact a stop surface 228 formed in the outlet fitting 112. The stop pins 226 provide small points of contact with the stop surface 228 to reduce the amount of noise generated when the damper flap 222 is pressed against the stop surface 228 by a back draft. In previous embodiments of similar exhaust fans, entire damper flap 222 contacts the stop surface 228 and generates a perceptible amount of flapping noise.

Figure 13:
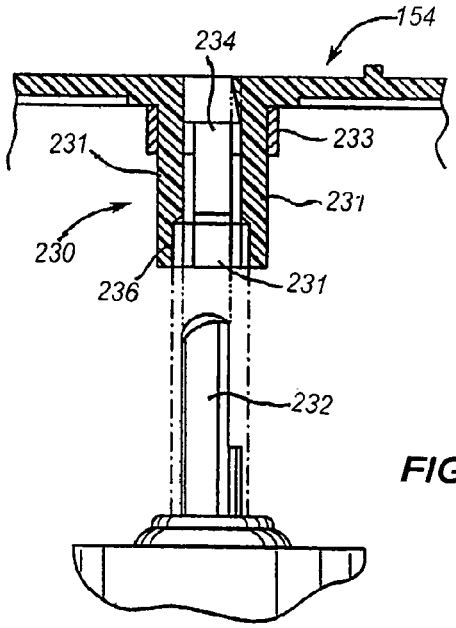
FIG. 13 is a section view of the ventilating exhaust fan shown in FIGS. 3 and 4, taken along line 13—13 of FIG. 4 and illustrating the mounting of the fan wheel onto a drive shaft of the driving motor.

Referring now to FIG. 13, the fan wheel 154 includes a central mounting hub 230 having independent fingers 231 that receives a drive shaft 232 of the driving motor 156. The mounting hub 230 includes a central bore 234 having an internal diameter approximately equal to the outer diameter of the drive shaft 232. A retaining band 233 surrounds the base of the independent fingers 231 to limit the outward flexing of the fingers 231. Thus, the mounting hub 230 is sized to receive the drive shaft 232 and retains the drive shaft 232 in the central bore 234 through a tight friction fit.

In accordance with the present invention, an insertion portion 236 is formed in the outer end of the mounting hub 230 to aid in insertion of the drive shaft 232 into the mounting hub 230. The insertion portion 236 is counterbored in the fingers 231 and has an inner diameter that is slightly greater than the inner diameter of the remaining portion of the central bore and thus slightly larger than the outer diameter of the drive shaft 232. In this manner, the drive shaft 232 can be easily inserted into the insertion portion 236 without any force being applied between the drive shaft 232 and the fan wheel 154. This feature is particularly important during assembly of the exhaust fan 110 since the fan wheel 154 is initially applied to the drive shaft 232 by a human assembly person during fabrication of the exhaust fan 110. After the human assembly person has placed the fan wheel 154 on the drive shaft 232, an automated machine presses the fan wheel 154 completely downward onto the drive shaft 232 to finally install the fan wheel 154 on the drive shaft 232. Without the insertion portion 236, the human assembly person would have a significantly more difficult time initially placing the fan wheel 154 on the drive shaft 232.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. Also, it should be noted that terms such as "front", "back", "top", "bottom", "side", "upward", "downward" and other terms of orientation used herein and in the appended claims are used for purposes of description only and neither indicate nor imply any limitation regarding the orientation of the present invention. Also, terms such as "first" and "second" are used herein and in the appended claims for purposes of description and are not intended to indicate or imply relative importance or significance.

What is claimed is:

1. A ventilation exhaust fan, comprising:

a housing having a fluid inlet through which fluid is received within the housing and a fluid outlet through which fluid exits the housing, the housing adapted to interchangeably receive a first module having a first support plate; and a second module having a second support plate, each of the first and second modules having at least one of a motor and a fan wheel operable to generate a flow of fluid out of the fluid outlet;

wherein the at least one of the fan wheel and the motor of the first module has a size different than the at least one of the fan wheel and the motor of the second module, respectively;

wherein the size is an axial length of each fan wheel;

wherein the size is a diameter of each fan wheel.

2. A ventilation exhaust fan, comprising:

a housing having a fluid inlet through which fluid is received within the housing and a fluid outlet through which fluid exits the housing, the housing adapted to interchangeably receive a first module having a first support plate; and a second module having a second support plate, each of the first and second modules having at least one of a motor and a fan wheel operable to generate a flow of fluid out of the fluid outlet;

wherein the at least one of the fan wheel and the motor of the first module has a size different than the at least one of the fan wheel and the motor of the second module, respectively;

wherein each of the first and second modules include a motor, and wherein the motor of the first module has a different size than the motor of the second module.

3. The ventilation exhaust fan of claim 2, wherein the size is a measure of output power of each motor.

4. The ventilation exhaust fan of claim 2, wherein the size is a dimension of each motor.

5. The ventilation exhaust fan of claim 2, wherein the housing has a first fastener, and wherein the first and second modules each have a second fastener releasably engageable with the first fastener to couple the first and second modules to the housing.

6. The ventilation exhaust fan of claim 5, wherein each of the second fasteners is a tab and the first fastener is a recess defined by the housing.

7. The ventilation exhaust fan of claim 2, wherein the second support plate defines a recess within which the fan wheel of the second module is at least partially received.

8. The ventilation exhaust fan of claim 2, wherein each of the first and second modules includes a motor, and wherein the motor of the first module has a position with respect to a periphery of the first support plate which is different than a position of the motor of the second module with respect to a periphery of the second support plate.

9. The ventilation exhaust fan of claim 2, wherein the housing includes a first electrical connector, and wherein the first and second modules each include a second electrical connector releasably engageable with the first electrical connector to electrically connect the housing with the first and second modules, respectively.

10. The ventilation exhaust fan of claim 2, wherein each of the first and second modules have a cover which is engageable with the housing adjacent the fluid inlet, wherein the cover of the first module has a different size than the cover of the second module.

11. The ventilation exhaust fan of claim 2, wherein each of the first and second support plates is pivotably engageable with the housing.

12. A replacement ventilation exhaust module for replacement of an existing ventilation module in a fan housing, the existing ventilation module having a first support plate, a first motor coupled to the first support plate, and a first fan wheel drivably coupled to the first motor, the first support plate releasably coupled within the fan housing at a location, the replacement ventilation exhaust module comprising:

a replacement support plate adapted to be releasably coupled to the fan housing at the location;

a replacement motor coupled to the replacement support plate; and a replacement fan wheel drivably coupled to the replacement motor;

wherein at least one of the replacement motor and the replacement fan wheel is different in size than the first motor and first fan wheel, respectively;

wherein the first motor has a first output power and the replacement motor has a second larger output power.

13. The replacement ventilation exhaust module of claim 12, wherein the first motor has a first size and the replacement motor has a second larger size.

14. The replacement ventilation exhaust module of claim 12, wherein the housing includes at least one fastener, and wherein the at least one fastener is engageable with each of the first module and the replacement module.

15. The replacement ventilation exhaust module of claim 12, wherein the housing includes a base wall, and wherein the replacement module is pivotably coupled with the housing for movement between a first position in which the replacement support plate is substantially parallel to the base wall, and a second position, in which the replacement support plate is at an angle with respect to the base wall.

16. The replacement ventilation exhaust module of claim 12, wherein the replacement support plate defines a recess within which the replacement fan wheel is at least partially received.

17. The replacement ventilation exhaust module of claim 12, wherein the housing includes an electrical connector, and wherein each of the first motor and the replacement motor is electrically connectable with the electrical connector to supply electrical power to the first module and the replacement module, respectively.

18. A replacement ventilation exhaust module for replacement of an existing ventilation module in a fan housing, the existing ventilation module having a first support plate, a first motor coupled to the first support plate, and a first fan wheel drivably coupled to the first motor, the first support plate releasably coupled within the fan housing at a location, the replacement ventilation exhaust module comprising:

a replacement support plate adapted to be releasable coupled to the fan housing at the location;

a replacement motor coupled to the replacement support plate; and a replacement fan wheel drivably coupled to the replacement motor;

wherein at least one of the replacement motor and the replacement fan wheel is different in size than the first motor and first fan wheel, respectively;

wherein the first motor has a first size and the replacement motor has a different size, and wherein the first module includes a first cover sized to at least partially enclose the first motor and the replacement module includes a replacement cover having a different size to at least partially enclose the replacement motor.

19. A ventilation exhaust fan, comprising:

a fan housing having a plurality of walls defining an interior space; and an outlet through which fluid is exhausted from the fan housing;

a first mounting plate;

a first motor coupled to the first mounting plate;

a first fan drivably coupled to the first motor, wherein the first mounting plate, the first motor, and the first fan are removable from and insertable within the fan housing as a single unit;

a second mounting plate;

a second motor coupled to the second mounting plate; and a second fan drivably coupled to the second motor, wherein the second mounting plate, the second motor, and the second fan are removable from and insertable within the fan housing as a single unit;

at least one of the first motor and first fan has a size different than the second motor and second fan, respectively;

wherein the first mounting plate is pivotably connectable with the housing.

20. The ventilation exhaust fan of claim 19, wherein the size is a measure of an axial length of the first and second fans.

21. The ventilation exhaust fan of claim 19, wherein the size is a measure of the output power of the first and second motors.

22. The ventilation exhaust fan of claim 19, wherein the first mounting plate and the second mounting plate each include at least one fastener, and wherein the fasteners are engageable with the housing to couple each of the first and second mounting plates to the housing.

23. The ventilation exhaust fan of claim 19, wherein the second mounting plate is pivotably connectable with the housing.

24. The ventilation exhaust fan of claim 19, wherein the second mounting plate defines a recess within which the second fan wheel is at least partially received.

25. The ventilation exhaust fan of claim 19, wherein the housing includes an electrical connector, and wherein each of the first motor and the second motor is electrically connectable with the electrical connector.

26. The ventilation exhaust fan of claim 19, further comprising a first cover releasably engageable with the housing to substantially enclose at least one of the first fan and the first motor and a second cover releasably engageable with the housing to substantially enclose at least one of the second fan and the second motor.

27. The ventilation exhaust fan of claim 19, further comprising a first cover releasably engageable with the housing and having a first volume and a second cover releasably engageable with the housing and having a second volume different that the first volume.

28. A method of changing a ventilation exhaust fan, comprising:

providing a housing defining an interior space and having an opening communicating between the interior space and an exterior of the housing;

providing a first module coupled to the housing, the first module having a first support plate, a first fan wheel, and a first motor operably coupled to the first fan wheel, at least a portion of the first module extending into the interior space;

uncoupling the first module from the housing;

withdrawing the first module from the interior space;

removing the first support plate from the opening;

inserting at least a portion of a second module into the interior space, the second module having a second support plate; and coupling the second module to the housing;

the second module having at least one of a second fan wheel and a second motor coupled to the second support plate, wherein the at least one of the second fan wheel and the second motor is different in size than the first fan wheel and the first motor, respectively.

29. The method of claim 28, wherein withdrawing the first module from the interior space includes pivoting the first support plate.

30. The method of claim 28, wherein the first support plate includes at least one fastener releasably engaged with the housing, and wherein uncoupling the first module from the housing includes uncoupling the at least one fastener from the housing.

31. The method of claim 28, wherein the second support plate includes at least one fastener releasably engaged with the housing, and wherein coupling the second module to the housing includes coupling the at least one fastener to the housing.

32. The method of claim 28, further comprising coupling a cover to the housing to substantially enclose the second module.

33. The method of claim 28, wherein the housing includes an electrical connector and the first motor is electrically engageable with the electrical connector to receive electrical power, the method further comprising uncoupling the first motor from the electrical connector without the use of tools.

34. The method of claim 33, further comprising electrically connecting the second motor to the electrical connector without the use of tools.

35. The method of claim 28, wherein the second support plate includes at least one fastener, and wherein coupling the second module to the housing includes engaging the at least one fastener with the housing and pivoting the second module from a first position in which the second support plate extends outwardly from the housing toward a second position in which the second support plate is positioned within the opening.

36. The method of claim 28, wherein the first module includes a cover, the method further comprising uncoupling the cover from the housing.

* * * * *